US010226161B2

(12) United States Patent
Gerstner et al.

(10) Patent No.: US 10,226,161 B2
(45) Date of Patent: Mar. 12, 2019

(54) LIFTING DEVICE AND WATER-BEARING DOMESTIC APPLIANCE

(71) Applicant: BSH Hausgeräte GmbH, Munich (DE)

(72) Inventors: Norbert Gerstner, Bolheim (DE); Marco Gleixner, Bachhagel (DE); Franz Kiechle, Günzburg (DE)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 421 days.

(21) Appl. No.: 15/039,036

(22) PCT Filed: Dec. 17, 2014

(86) PCT No.: PCT/EP2014/078219
§ 371 (c)(1),
(2) Date: May 25, 2016

(87) PCT Pub. No.: WO2015/091646
PCT Pub. Date: Jun. 25, 2015

(65) Prior Publication Data

US 2017/0027413 A1 Feb. 2, 2017

(30) Foreign Application Priority Data

Dec. 20, 2013 (DE) ..... 10 2013 226 910

(51) Int. Cl.
*A47L 15/50* (2006.01)

(52) U.S. Cl.
CPC ..... *A47L 15/506* (2013.01)

(58) Field of Classification Search
CPC ..... A47L 15/506
(Continued)

(56) References Cited

U.S. PATENT DOCUMENTS 7,731,805 B2 6/2010 Banta et al.
2006/0021373 A1 2/2006 Oh et al.
(Continued)

FOREIGN PATENT DOCUMENTS

CN 1711951 A 12/2005
CN 201055528 Y 5/2008
(Continued)

OTHER PUBLICATIONS

Machine translation of Osterle et al. (EP0147815A2) (Year: 1985).*
(Continued)

*Primary Examiner* — Michael E Barr
*Assistant Examiner* — Tinsae B Ayalew
(74) *Attorney, Agent, or Firm* — Michael E. Tschupp; Andre Pallapies; Brandon G. Braun

(57) ABSTRACT

A lifting device for a holder for items to be washed of a water-bearing domestic appliance includes a driving apparatus configured to generate a supporting force to assist a manual movement of the holder into a washing container of the water-bearing domestic appliance as the holder is lowered and to generate a supporting force to assist a manual movement of the holder out of the washing container as the holder is raised. The driving apparatus is activated by a control apparatus so as to generate the supporting force during the manual movement of the holder.

30 Claims, 6 Drawing Sheets

(58) Field of Classification Search
USPC ..... 134/58 D
See application file for complete search history.

(56) References Cited

U.S. PATENT DOCUMENTS

| | | | | |
|---|---|---|---|---|
| 2007/0035220 | A1 | 2/2007 | Bond et al. | |
| 2009/0009040 | A1 | 1/2009 | Dellby et al. | |
| 2009/0248207 | A1* | 10/2009 | Yoo | F25D 25/025 700/275 |
| 2012/0074080 | A1 | 3/2012 | Garcia et al. | |

FOREIGN PATENT DOCUMENTS

| | | | |
|---|---|---|---|
| CN | 201481857 | U | 5/2010 |
| EP | 0147815 | A2 | 7/1985 |
| EP | 0147815 | B1 | 2/1990 |

OTHER PUBLICATIONS

Report of Examination DE 10 2013 226 910.2 dated Aug. 5, 2014.
International Search Report PCT/EP2014/078219 dated Feb. 9, 2015.

* cited by examiner

LIFTING DEVICE AND WATER-BEARING DOMESTIC APPLIANCE

CROSS-REFERENCES TO RELATED APPLICATIONS

This application is the U.S. National Stage of International Application No. PCT/EP2014/078219, filed Dec. 17, 2014, which designated the United States and has been published as International Publication No. WO 2015/087208 and which claims the priority of German Patent Application, Serial No. 10 2013 226 910.2, filed Dec. 20, 2013, pursuant to 35 U.S.C. 119(a)-(d).

BACKGROUND OF THE INVENTION

The present invention relates to a lifting device for a holder for items to be washed of a water-bearing domestic appliance and to a water-bearing domestic appliance.

A dishwasher has a washing container and at least one holder for items to be washed, which holder for items to be washed can be moved into the washing container or out of the same. In particular, the dishwasher can have a number of holders for items to be washed, which holders are arranged one above the other, such as a lower basket, an upper basket or a cutlery basket, for example. Since the lower basket is arranged close to a base wall of the washing container, it is necessary for the user to kneel or bend down toward the lower basket in order to load and unload the lower basket.

The publication WO 2005/104924 A1 describes a lifting device for a lower basket of a dishwasher. With the aid of the lifting device, the lower basket can be raised from a lower position to an upper position or lowered from the upper position to the lower position.

BRIEF SUMMARY OF THE INVENTION

Against this background, an object of the present invention is to provide an improved lifting device.

Accordingly, a lifting device for a holder for items to be washed of a water-bearing domestic appliance is proposed, wherein the holder for items to be washed can be moved selectively into a washing container of the water-bearing domestic appliance or out of said washing container. The lifting device is configured to raise the holder for items to be washed when the holder is moved out of the washing container and to lower the holder for items to be washed when the holder is moved into the washing container. The lifting device has a driving apparatus and a control apparatus, the control apparatus being configured to actuate the driving apparatus in such a way, when the holder for items to be washed is moved manually, that the driving apparatus assists the manual movement of the holder for items to be washed by means of a supporting force.

The water-bearing domestic appliance is preferably a dishwasher. The driving apparatus can be configured in particular to actuate the driving apparatus in such a way during a manual movement of the holder for items to be washed that the driving apparatus supports the manual movement of the holder for items to be washed with an assistance torque. The holder for items to be washed is preferably a lower holder for items to be washed or a lower basket of the dishwasher. An upper holder for items to be washed or an upper basket or cutlery basket can be arranged in the washing container above the lower holder for items to be washed. Because the driving apparatus simply assists the manual movement and does not automatically move the holder for items to be washed out of the washing container or into the washing container, an unwanted movement, for example an unwanted complete withdrawal of the holder for items to be washed from the washing container, is reliably prevented. As a result the user is not exposed to any risk of injury. The lifting device is configured in particular to move the lower holder for items to be washed up to the same level as the upper holder for items to be washed and at the same time to position the lower holder in front of the upper holder for items to be washed.

According to one embodiment, the control apparatus is configured to actuate the driving apparatus during a manual movement of the holder for items to be washed as a function of a manual operating force.

In particular, the supporting force is proportional to the manual operating force. Preferably, a direct proportionality exists between the manual operating force and the supporting force. In other words, the higher the manual operating force, the higher also is the supporting force applied by the driving apparatus. This results in a particularly high degree of user friendliness.

According to a further embodiment, the lifting device has a sensor apparatus for detecting the manual operating force.

The sensor apparatus can be part of the driving apparatus or of the control apparatus. Preferably, the driving apparatus, the control apparatus and the sensor apparatus form a single common compact module. This enables the lifting device to be utilized even in restricted space conditions.

According to a further embodiment, the sensor apparatus has a torque sensor.

This enables the manual operating force applied by the user during the manual movement to be determined particularly easily and precisely. Preferably, the control apparatus estimates the requisite supporting force on the basis of an output signal of the torque sensor.

According to a further embodiment, the torque sensor is arranged on or at an output shaft of the driving apparatus.

This permits a simple and space-saving installation of the torque sensor. As a result of the direct mounting of the torque sensor at or on the output shaft, the manual operating force exerted by the user or, as the case may be, a torque applied by the user can be determined particularly precisely.

According to a further embodiment, the control apparatus is configured to actuate the driving apparatus in such a way that the holder for items to be washed remains in its current position when the manual operating force is removed.

By the current or most recent position, in the present context, is to be understood the position in which the user no longer applies any manual operating force to the holder for items to be washed. In particular, in a state in which the holder for items to be washed has, for example, been partially moved out of or into the washing container, the control apparatus can actuate the driving apparatus in such a way that the holder for items to be washed is held in the most recent position. The next time that the holder for items to be washed is moved manually, the driving apparatus once again exerts the supporting force.

According to a further embodiment, the driving apparatus can be locked in the current position.

For this purpose the driving apparatus can have an optional locking device. The locking device can have a catch mechanism or a brake, for example.

According to a further embodiment, the driving apparatus has a servo motor.

In particular, the driving apparatus can be a servo motor. A precise actuation of the driving apparatus is possible by this means, since the servo motor continuously transmits an angular position of the output shaft to the control apparatus.

According to a further embodiment, the servo motor is arranged in or on a side wall of the water-bearing domestic appliance.

Preferably, the servo motor is arranged between a side wall of the washing container and the side wall of the domestic appliance. In particular, the control apparatus also is positioned on or in the side wall of the water-bearing domestic appliance. This results in a particularly space-saving design of the lifting device.

According to a further embodiment, the lifting device has a swivel arm for moving the holder for items to be washed, the swivel arm being pivotably attached to the washing container of the water-bearing domestic appliance and to the holder for items to be washed.

With the aid of the swivel arm, the holder for items to be washed can be moved out of or into the washing container in the manner of a pendulum. In particular, this enables the holder for items to be washed to be moved to the same level as and in front of the upper holder for items to be washed. One of the swivel arms is coupled in a rotationally fixed manner to the output shaft of the driving apparatus.

According to a further embodiment, the lifting device has two swivel arms arranged spaced apart at a distance from one another.

The swivel arms are preferably attached to the holder for items to be washed in a spaced-apart manner at a distance from one another. In particular, end sections of the swivel arms are pivotably mounted on the washing container. In the state in which the holder for items to be washed is moved into the washing container, the swivel arms are preferably inclined in the direction of a back wall of the washing container.

According to a further embodiment, the lifting device has a rail apparatus along which the swivel arm is guided.

This enables the holder for items to be washed to be moved particularly far out of the washing container. An even more user-friendly loading and unloading of the holder for items to be washed is possible as a result.

According to a further embodiment, the lifting device has a toothed rack that is operatively connected to the holder for items to be washed and a pinion gear that is located in engagement with the toothed rack. The pinion gear is operatively connected to the driving apparatus.

The toothed rack is preferably curved. The toothed rack is in particular partly circular in shape and is pivotably attached to the washing container at a center point of the partly circular shape. The toothed rack is furthermore preferably coupled in addition to the holder for items to be washed. The pinion gear is coupled to the output shaft of the driving apparatus in particular in a rotationally fixed manner.

According to a further embodiment, the toothed rack is curved in an arcuate shape.

In particular, the toothed rack is curved in a circular arc shape. The toothed rack can have the shape of a quadrant, for example.

Also proposed is a water-bearing domestic appliance having a lifting device of said type.

The water-bearing domestic appliance is preferably a dishwasher.

Other possible implementations of the invention also comprise combinations, not explicitly cited, of features or embodiments described in the foregoing or in the following in relation to the exemplary embodiments. In this regard the person skilled in the art will also add individual aspects as improvements or supplements to the respective basic form of the invention.

BRIEF DESCRIPTION OF THE DRAWINGS

Further advantageous embodiments and aspects of the invention are the subject matter of the dependent claims, as well as of the below-described exemplary embodiments of the invention. The invention is explained in more detail hereinbelow with the aid of preferred embodiments and with reference to the attached figures, in which:

DETAILED DESCRIPTION OF EXEMPLARY EMBODIMENTS OF THE PRESENT INVENTION

Figure 1:
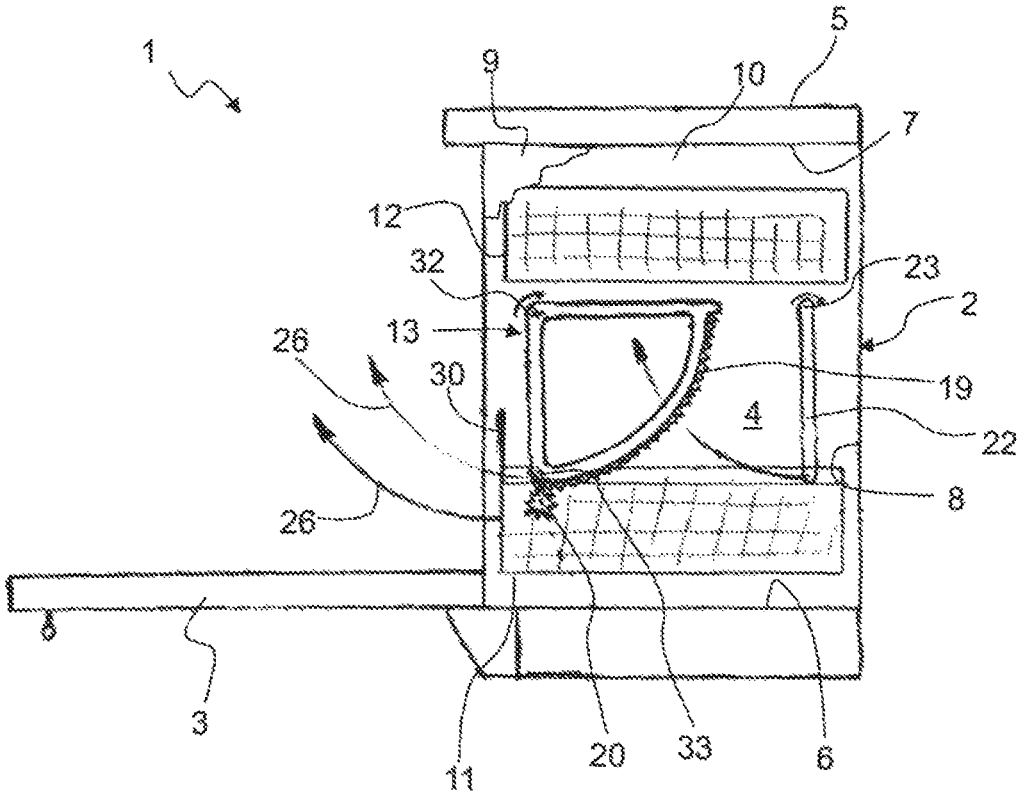
FIG. 1 shows a schematic sectional view of an embodiment of a water-bearing domestic appliance.

Unless stated otherwise, identical or functionally identical elements are designated by the same reference numerals throughout the figures.

Figure 2:
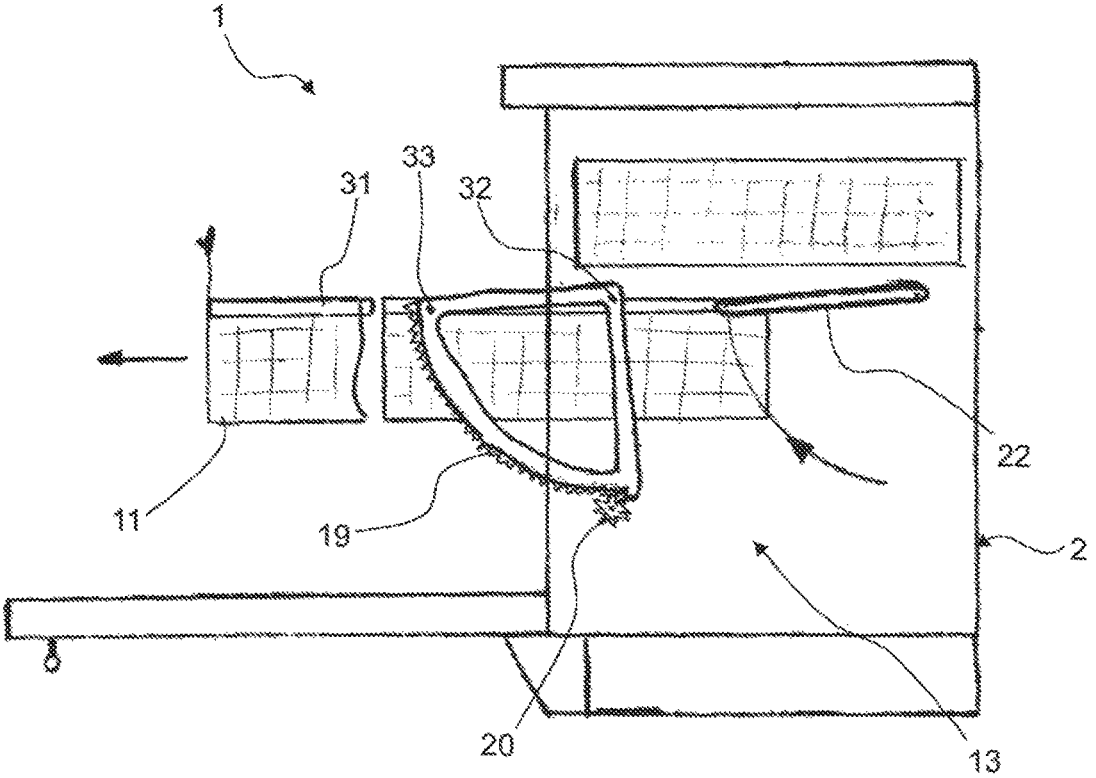
FIG. 2 shows a further schematic sectional view of the water-bearing domestic appliance according to FIG. 1.

FIG. 1 and FIG. 2 each show a schematic sectional view of an embodiment of a water-bearing domestic appliance 1. The water-bearing domestic appliance 1 is preferably a dishwasher. The domestic appliance 1 has a washing container 2 which can be closed, in particular in a water-tight manner, by means of a door 3. To that end, a sealing apparatus can be provided between the door 3 and the washing container 2. The washing container 2 and the door 3 can form a washing chamber 4 of the domestic appliance 1 for washing items to be washed. The washing container 2 can be arranged in the interior of a housing 5 of the domestic appliance 1. The door 3 is shown in its open position in FIG. 1. The door 3 can be closed or opened by a pivoting movement about an axis of rotation provided at a lower end of the door 3.

The washing container 2 has a base wall 6, a top wall 7 arranged on the opposite side to the base wall 6, and a back wall 8 arranged on the opposite side to the door 3. The washing container 2 additionally has side walls 9, 10 arranged opposite one another. The washing container 2 is preferably cuboid-shaped. The washing container 2 is preferably made from a metal material, in particular from a sheet metal. The base wall 6 can also be fabricated from a plastic material.

The domestic appliance 1 has at least one holder 11 for items to be washed. The holder 11 for items to be washed is preferably box-shaped. A base wall and side walls of the holder 11 for items to be washed are grid-shaped. Preferably, the domestic appliance 1 has several holders 11, 12 for items to be washed. The number of holders 11, 12 for items to be washed is arbitrary. A lower holder 11 for items to be washed or a lower basket and an upper holder 12 for items to be washed or an upper basket of the domestic appliance 1 are shown in FIG. 1. The domestic appliance 1 can additionally have a cutlery basket. The holders 11, 12 for items to be washed are preferably arranged one above the other in the washing container 2. Each holder 11, 12 for items to be washed can be moved selectively into or out of the washing container 2. A handle 30 can be provided on each of the holders 11, 12 for items to be washed.

Figure 3:
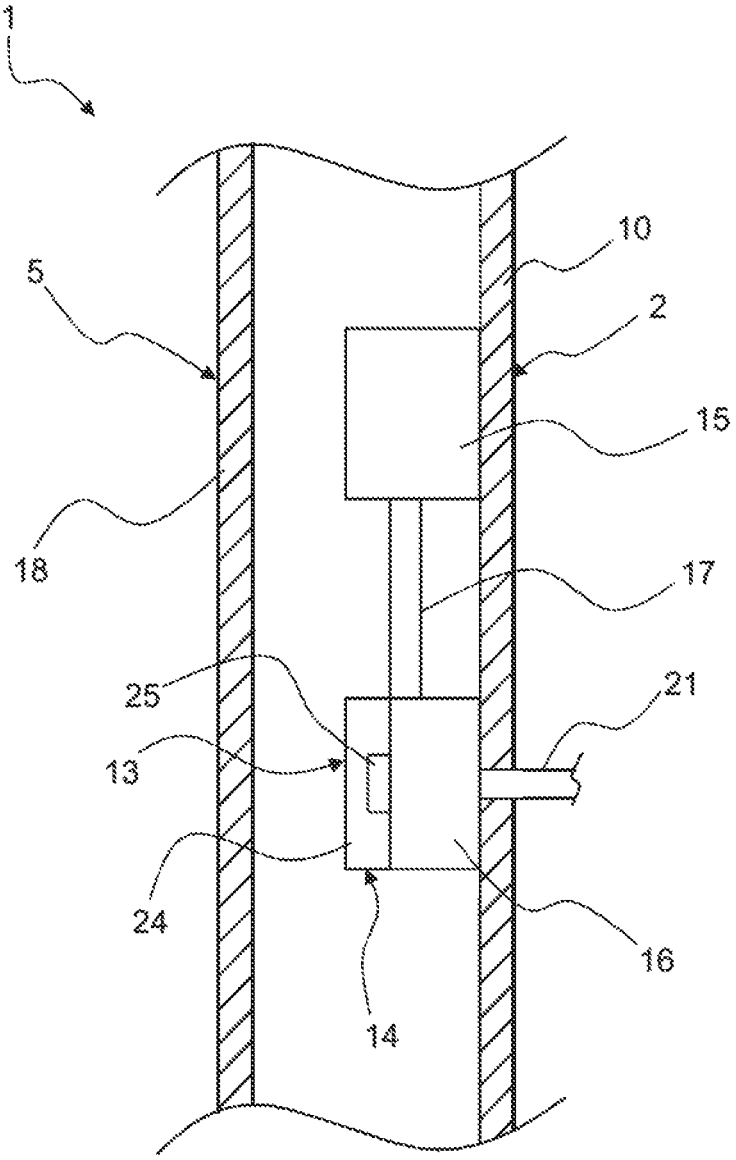
FIG. 3 shows a schematic partial sectional view of the water-bearing domestic appliance according to FIG. 1.

The domestic appliance 1 comprises a lifting device 13 which is configured to raise the lower holder 11 for items to be washed when said holder is moved out of the washing container 2 and to lower the lower holder 11 for items to be washed when said holder is moved into the washing container 2. As FIG. 3 shows, the lifting device 13 has a driving apparatus 14 (also referred to as means for generating a supporting force) and a control apparatus 15. The driving apparatus 14 comprises a servo motor 16 or is embodied as a servo motor 16. The control apparatus 15 is connected to the driving apparatus 14 via a control line 17. A power supply of the driving apparatus 14 can also be implemented via the control line 17. Alternatively, the driving apparatus 14 can be driven pneumatically or hydraulically. The driving apparatus 14 or, as the case may be, the servo motor 16 is arranged in or on a side wall 18 of the water-bearing domestic appliance 1. As FIG. 3 shows, the driving apparatus 14 and the control apparatus 15 are positioned between the side wall 10 of the washing container 2 and the side wall 18 of the housing 5 of the domestic appliance 1. The control apparatus 15 can furthermore be integrally embodied with the driving apparatus 14. This results in a particularly compact design of the lifting device 13. In particular, the control apparatus 15 operates autonomously, that is to say it preferably operates independently of a control apparatus of the water-bearing domestic appliance 1. The control apparatus of the domestic appliance 1 can actuate a drain pump and/or a heat pump, for example.

FIG. 1 shows the holder 11 for items to be washed in its initial state, in which it has been moved into position in the washing container 2. FIG. 2 shows the holder 11 for items to be washed in its final state, in which it has been moved out of the washing container 2. In the moved-out state, the lower holder 11 for items to be washed is arranged at least partially in front of the upper holder 12 for items to be washed. The control apparatus 15 is configured to actuate the driving apparatus 14 in such a way during a manual movement of the holder 11 for items to be washed that the driving apparatus 14 assists the manual movement of the holder 11 for items to be washed with a supporting force. A lifting device 13 can be provided on both sides of the holder for items to be washed, in which case preferably only one of the two lifting devices 13 will have a driving apparatus 14. Alternatively, both lifting devices 13 can comprise a driving apparatus 14.

In order to raise and lower the holder 11 for items to be washed when the holder is being moved out of or into the washing container, the lifting device 13 has a toothed rack 19. In addition, the lifting device 13 comprises a pinion gear 20 that is provided on the side wall 9, 10. The pinion gear 20 is connected in a rotationally fixed manner to an output shaft 21 (shown in FIG. 3) of the driving apparatus 14. The toothed rack 19 is in particular curved in an arcuate shape. Preferably, the toothed rack 19 is curved in a circular arc shape. As FIG. 1 and FIG. 2 show, the toothed rack 19 can have the shape of a quadrant. The toothed rack 19 is in particular pivotably attached at a center point 32 of its circular arc shape to the side wall 9, 10. The attachment can be realized with the aid of a rivet or a bolt, for example. In addition, the toothed rack 19 is pivotably connected to the holder 11 for items to be washed at an attachment point 33. The attachment point 33 is preferably positioned circumferentially on the toothed rack 19. At the attachment point 33, the toothed rack 19 can, for example, be riveted, screwed or bolted to the holder 11 for items to be washed.

The lifting device 13 additionally has a swivel arm 22. The swivel arm 22 is pivotably attached to a side wall 9, 10 of the washing container 2. An attachment element 23 of the swivel arm is preferably arranged relative to the base wall 6 of the washing container 2 at the same height as the center point 32 of the toothed rack 19. The attachment element 23 can be a rivet, for example. The swivel arm 22 is pivotably attached to the lower holder 11 for items to be washed by means of an end section facing away from the attachment element 23.

Furthermore, a rail apparatus 31 can optionally be provided on the holder 11 for items to be washed. In the raised state shown in FIG. 2, the holder 11 for items to be washed can be moved even further out of the washing container 2 with the aid of the rail apparatus 31.

The lifting device 13 can have a sensor apparatus 24 for detecting a manual operating force. The manual operating force is applied to the handle 30 by the user. The sensor apparatus 24 can be an integral part of the driving apparatus 14. Alternatively, the sensor apparatus 24 can be an integral part of the control apparatus 15. The sensor apparatus 24 preferably has a torque sensor 25. The torque sensor 25 is arranged on or at the output shaft 21 of the driving apparatus 14, in particular of the servo motor 16. The control apparatus 15 determines the manual operating force based on a signal of the torque sensor 25.

The operation of the lifting device 13 is explained in the following. In order to move the holder 11 for items to be washed out of the washing container 2, a user grips the handle 30 of the holder 11 for items to be washed and moves said holder 11 out of the washing container 2. When the holder 11 for items to be washed is being moved out of the washing container 2, as indicated by means of arrows 26 in FIG. 1, the control apparatus 15 actuates the driving apparatus 14 as a function of the manual operating force. In other words, the higher the manual operating force applied by the user, the higher also is the supporting force generated by the driving apparatus 14. In particular, the supporting force is proportional to the manual operating force.

As soon as a manual operating force is no longer applied to the holder 11 for items to be washed, the control apparatus 15 switches off the driving apparatus 14, with the result that the holder 11 for items to be washed remains in its current or most recent position. In particular, the driving apparatus 14 can be actuated by the control apparatus 15 in such a way that the holder 11 for items to be washed is held by the driving apparatus 14 in the most recent position in which a manual operating force was applied to the holder 11 for items to be washed. The driving apparatus 14 can furthermore be lockable in the current position. To that end, the driving apparatus 14 can have a locking element.

Figure 4:
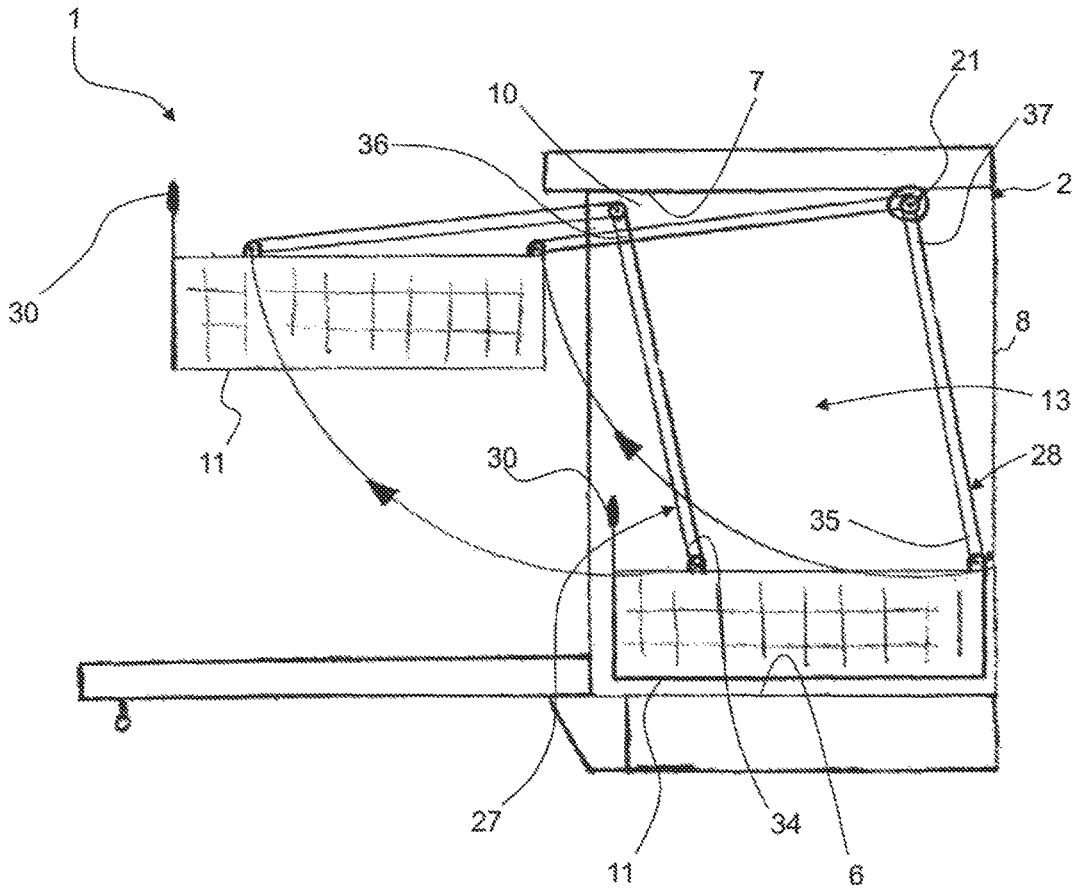
FIG. 4 shows a schematic sectional view of a further embodiment of a water-bearing domestic appliance.

FIG. 4 shows the water-bearing domestic appliance 1 with a further embodiment of the lifting device 13. The lifting device 13 according to FIG. 4 differs from the lifting device 13 according to FIG. 1 to FIG. 3 in that two swivel arms 27, 28 arranged spaced apart at a distance from one another are provided in lieu of the swivel arm 22 and the toothed rack 19. In FIG. 4, the holder 11 for items to be washed is shown both in the position in which it has been moved into the washing container 2 and in the position in which it has been moved out of the washing container 2. Each swivel arm 27, 28 is pivotably mounted on the holder 11 for items to be washed by means of a respective end section 34, 35. The end sections 34, 35 are spaced apart at a distance from one another and attached to the holder 11 for items to be washed. The swivel arms 27, 28 are arranged in such a way that they are inclined in the direction of the back wall 8 of the washing container 2. The swivel arm 27 is movably attached to the side wall 9, 10 by means of an end section 36 facing away from the end section 34. The end section 36 can be pivotably riveted or screwed to the side wall 9, 10. The swivel arm 28 is fixedly connected to the output shaft 21 of the driving apparatus 14 at an end section 37 facing away from the end section 35. The functionality of the lifting device 13 according to FIG. 4 corresponds to the functionality of the lifting device 13 according to FIG. 1 to FIG. 3.

Figure 5:
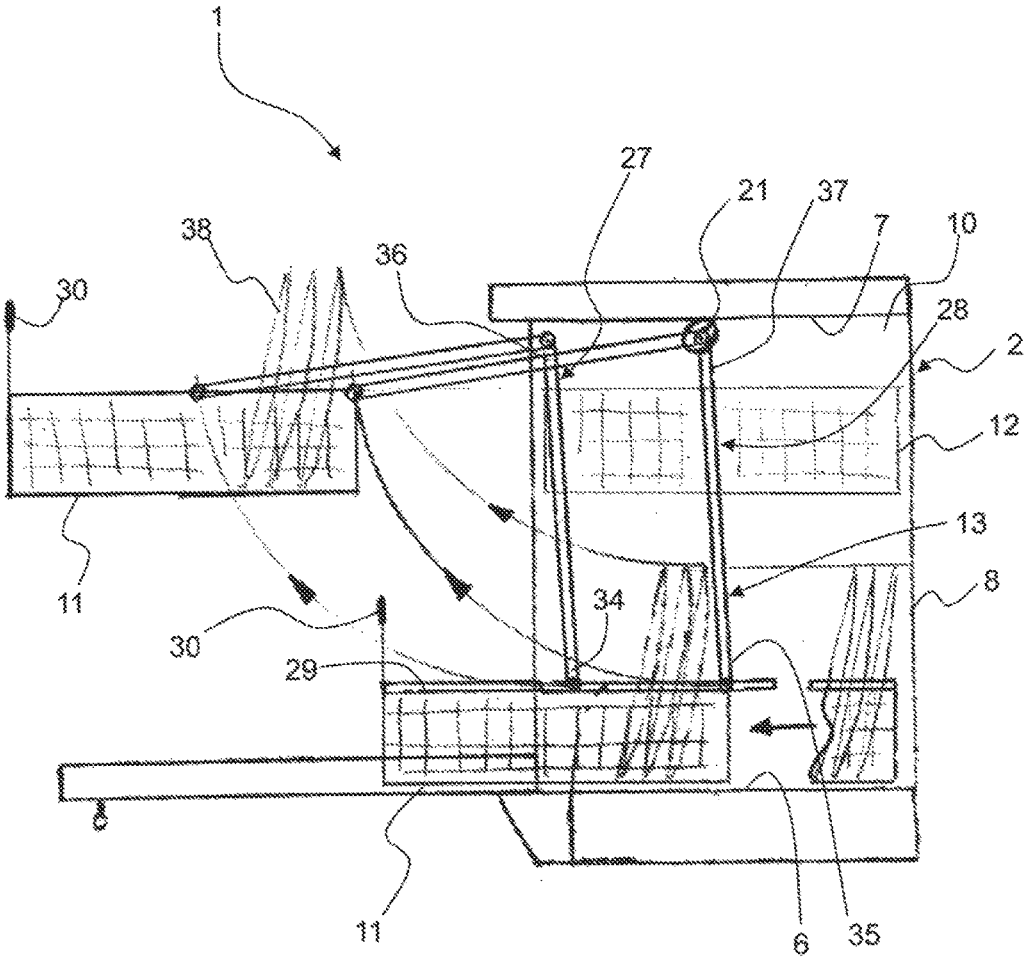
FIG. 5 shows a schematic sectional view of a further embodiment of a water-bearing domestic appliance.

FIG. 5 shows the water-bearing domestic appliance 1 with a further embodiment of the lifting device 13. The lifting device 13 according to FIG. 5 differs from the lifting device 13 according to FIG. 4 in that a rail apparatus 29 is provided on the holder 11 for items to be washed. Items to be washed 38, such as plates, for example, are arranged in the holder 11 for items to be washed. The swivel arms 27, 28 are spaced apart at a distance from one another by means of their end sections 34, 35 and pivotably attached to the rail apparatus 29. The swivel arm 27 is additionally pivotably mounted on the side wall 9, 10 of the washing container 2 by means of its end section 36. The swivel arm 28 is operatively connected to the output shaft 21 of the driving apparatus 14 in a rotationally fixed manner by means of its end section 37.

In order to move the holder 11 for items to be washed out of the washing container 2, said holder 11 is initially moved along the rail apparatus 29 relative to the swivel arms 27, 28. When the holder 11 for items to be washed is moved further out of the washing container 2, the lifting device 13 assists, as previously explained, the movement of the holder 11 for items to be washed by means of the supporting force. By this means it is possible in particular to guide the lower holder 11 for items to be washed around the upper holder 12 for items to be washed that is arranged above the lower holder 11. In the state of the lower holder 11 for items to be washed in which it has been moved out of the washing container, said lower holder 11 is arranged in particular at the same level as and in front of the upper holder 12 for items to be washed. A particularly easy and convenient loading of the holder 11 for items to be washed is possible as a result.

Figure 6:
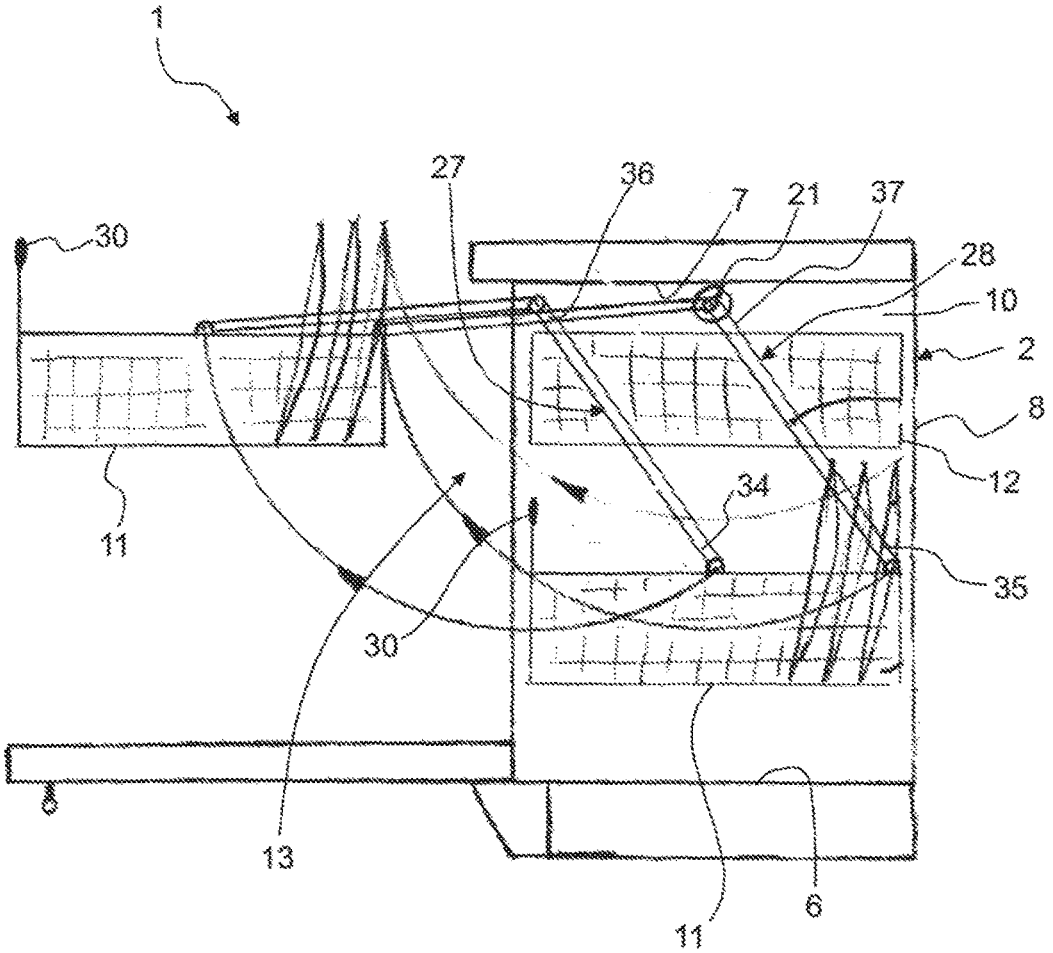
FIG. 6 shows a schematic sectional view of a further embodiment of a water-bearing domestic appliance.

FIG. 6 shows the water-bearing domestic appliance 1 with a further embodiment of the lifting device 13. The embodiment of the lifting device 13 according to FIG. 6 differs from the embodiment of the lifting device 13 according to FIG. 4 only in that the swivel arms 27, 28 are more steeply inclined in the direction of the back wall 8 of the washing container 2. This enables the holder 11 for items to be washed to be moved even further in an upward direction, as a result of which the holder 11 for items to be washed can be loaded more easily and more quickly.

Although the present invention has been described with reference to exemplary embodiments, it lends itself to a wide variety of modifications.

The invention claimed is:

1. A lifting device for a basket for items to be washed of a water-bearing domestic appliance, said lifting device comprising:

a driving apparatus comprising a servo motor and configured to generate a supporting force to assist a manual movement of the basket into a washing container of the water-bearing domestic appliance as the basket is lowered and to generate a supporting force to assist a manual movement of the basket out of the washing container as the basket is raised; and a control apparatus electrically connected to the driving apparatus and configured to activate the driving apparatus and thereby generate the supporting force in response to the manual movement of the basket.

2. The lifting device of claim 1, wherein the control apparatus is configured to activate the driving apparatus during the manual movement of the basket as a function of a manual operating force.

3. The lifting device of claim 2, further comprising a sensor apparatus configured to detect the manual operating force.

4. The lifting device of claim 3, wherein the sensor apparatus has a torque sensor.

5. The lifting device of claim 4, wherein the torque sensor is arranged on or at an output shaft of the driving apparatus.

6. The lifting device of claim 2, wherein the control apparatus is configured to activate the driving apparatus in such a way that the basket remains in its current position when the manual operating force is removed.

7. The lifting device of claim 1, wherein the driving apparatus is configured such as to be locked in the current position.

8. The lifting device of claim 1, wherein the servo motor is arranged in or on a side wall of the water-bearing domestic appliance.

9. The lifting device of claim 1, further comprising a swivel arm configured to move the basket, said swivel arm being pivotably attached to the washing container and to the basket.

10. The lifting device of claim 9, further comprising a rail apparatus along which the swivel arm is guided.

11. The lifting device of claim 1, further comprising two swivel arms configured to move the basket, said swivel arms being pivotably attached in spaced-apart relationship to the washing container and to the basket.

12. The lifting device of claim 11, further comprising a rail apparatus along which the swivel arms are guided.

13. The lifting device of claim 1, further comprising a toothed rack operatively connected to the basket, and a pinion gear disposed in engagement with the toothed rack and operatively connected to the driving apparatus.

14. The lifting device of claim 13, wherein the toothed rack is curved in an arcuate shape.

15. A water-bearing domestic appliance, comprising:

a basket for items to be washed;

a lifting device including a driving apparatus comprising a servo motor and configured to generate a supporting force to assist a manual movement of the basket into a washing container of the water-bearing domestic appliance as the basket is lowered and to generate a supporting force to assist a manual movement of the basket out of the washing container as the basket is raised; and a control apparatus electrically connected to the driving apparatus and configured to activate the driving apparatus and thereby generate the supporting force in response to the manual movement of the basket.

16. The water-bearing domestic appliance of claim 15, wherein the control apparatus is configured to activate the driving apparatus during the manual movement of the basket as a function of a manual operating force.

17. The water-bearing domestic appliance of claim 16, wherein the lifting device includes a sensor apparatus configured to detect the manual operating force.

18. The water-bearing domestic appliance of claim 17, wherein the sensor apparatus has a torque sensor.

19. The water-bearing domestic appliance of claim 18, wherein the torque sensor is arranged on or at an output shaft of the driving apparatus.

20. The water-bearing domestic appliance of claim 16, wherein the control apparatus is configured to activate the driving apparatus in such a way that the basket remains in its current position when the manual operating force is removed.

21. The water-bearing domestic appliance of claim 20, wherein the driving apparatus is configured such as to be locked in the current position.

22. The water-bearing domestic appliance of claim 15, further comprising a side wall, said servo motor being arranged in or on the side wall.

23. The water-bearing domestic appliance of claim 15, wherein the lifting device includes a swivel arm configured to move the basket, said swivel arm being pivotably attached to the washing container and to the basket.

24. The water-bearing domestic appliance of claim 23, wherein the lifting device includes a rail apparatus along which the swivel arm is guided.

25. The water-bearing domestic appliance of claim 15, wherein the lifting device includes two swivel arms configured to move the basket, said swivel arms being pivotably attached in spaced-apart relationship to the washing container and to the basket.

26. The water-bearing domestic appliance of claim 25, wherein the lifting device includes further comprising a rail apparatus along which the swivel arms are guided.

27. The water-bearing domestic appliance of claim 15, wherein the lifting device includes a toothed rack operatively connected to the basket, and a pinion gear disposed in engagement with the toothed rack and operatively connected to the driving apparatus.

28. The water-bearing domestic appliance of claim 27, wherein the toothed rack is curved in an arcuate shape.

29. A water-bearing domestic appliance, comprising:

a basket for items to be washed;

a lifting device including means for generating a supporting force to assist a manual movement of the basket into a washing container of the water-bearing domestic appliance as the basket is lowered and to generate a supporting force to assist a manual movement of the basket out of the washing container as the basket is raised; and a control apparatus electrically connected to the means for generating a supporting force and configured to activate the means for generating a supporting force and thereby generate the supporting force during the manual movement of the basket, wherein the control apparatus is configured to activate the means for generating a supporting force only in response to a manual movement of the basket as a function of a manual operating force, so that as soon as the manual operating force is no longer applied to the basket, the control apparatus switches off the means for generating a supporting force.

30. A water-bearing domestic appliance, comprising:

a basket for items to be washed;

a lifting device including means for generating a supporting force to assist a manual movement of the basket into a washing container of the water-bearing domestic appliance as the basket is lowered and to generate a supporting force to assist a manual movement of the basket out of the washing container as the basket is raised; and a control apparatus electrically connected to the means for generating a supporting force and configured to activate the means for generating a supporting force and thereby generate the supporting force in response to the manual movement of the basket, wherein the control apparatus is configured to activate the means for generating a supporting force during the manual movement of the basket as a function of a manual operating force, and wherein the lifting device includes a sensor apparatus comprising a torque sensor and configured to detect the manual operating force.

* * * * *